US008155561B2

(12) United States Patent
Katayama

(10) Patent No.: US 8,155,561 B2
(45) Date of Patent: Apr. 10, 2012

(54) IMAGE FORMING APPARATUS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 511 days.

(21) Appl. No.: 12/395,237

(22) Filed: Feb. 27, 2009

(65) Prior Publication Data

US 2010/0119259 A1 May 13, 2010

(30) Foreign Application Priority Data

Nov. 12, 2008 (JP) ..... 2008-290000

(51) Int. Cl.
*G03G 15/00* (2006.01)
*G03G 15/08* (2006.01)

(52) U.S. Cl. ..... 399/159; 399/279

(58) Field of Classification Search ..... 399/117, 399/222, 265, 159, 227, 279
See application file for complete search history.

(56) References Cited

U.S. PATENT DOCUMENTS 6,385,417 B1 * 5/2002 Tanaka et al. ..... 399/164

FOREIGN PATENT DOCUMENTS

| | | | |
|---|---|---|---|
| JP | 06-067525 | | 3/1994 |
| JP | 7-199648 | | 8/1995 |
| JP | 10-232526 | | 9/1998 |
| JP | 11-015269 | | 1/1999 |
| JP | 11015269 A | * | 1/1999 |
| JP | 2003-122120 | | 4/2003 |

* cited by examiner

*Primary Examiner* — David Gray
*Assistant Examiner* — Frederick Wenderoth
(74) *Attorney, Agent, or Firm* — Canon USA Inc IP Division

(57) ABSTRACT

A positioning roller is configured to be pressed against an abutment block by a reactive force produced when the positioning roller abuts on an S-D-direction abutment block.

7 Claims, 16 Drawing Sheets

IMAGE FORMING APPARATUS

BACKGROUND OF THE INVENTION

1. Field of the Invention

The present invention relates to image forming apparatuses, such as copiers and laser beam printers, which form a visible image from an electrostatic latent image on a latent-image bearing member by using a developing device.

2. Description of the Related Art

As shown in FIG. 4, a photosensitive drum 1 and a developing sleeve 12 of an image forming apparatus are disposed with a slight sleeve-and-drum (S-D) gap Gsd constantly maintained therebetween so as to allow for a predetermined developing process. If this S-D gap Gsd fluctuates, image formation defects, such as uneven densities of images, can occur.

In related art, the opposite ends/sides of the developing sleeve are respectively provided with positioning rollers for maintaining a fixed gap between the photosensitive drum and the developing sleeve. Specifically, these rollers have a radius greater than that of the developing sleeve by an amount equivalent to the S-D gap and are disposed in abutment with the photosensitive drum so as to maintain a fixed S-D gap. See Japanese Patent Laid-Open No. H06-067525 for an example.

FIG. 5 illustrates a configuration similar to that disclosed in Japanese Patent Laid-Open No. H06-067525. As shown in FIG. 5, the opposite ends/sides of the developing sleeve 12 rotatably support positioning rollers 20 by means of bearings 24. One end of the developing sleeve 12 is provided with a gear 23 that applies a driving force for rotating the developing sleeve 12. The gear 23 is configured to receive the driving force from the outside of a developing device 3.

The S-D gap Gsd is set by bringing the positioning rollers 20 provided at the opposite ends/sides of the developing sleeve 12 into abutment with the outer peripheral surface of the photosensitive drum 1, whereby the developing sleeve 12 can be disposed while the predetermined S-D gap Gsd is maintained between the developing sleeve 12 and the photosensitive drum 1.

In this case, since the positioning rollers 20 are provided by means of the bearings 24, the positioning rollers 20 rotate together with the photosensitive drum 1, whereas the inner periphery of each of the bearings 24 rotates together with the developing sleeve 12.

In order to place the positioning rollers 20 in abutment with the outer peripheral surface of the photosensitive drum 1, the base ends of springs 18 are first attached to a rear section of a developer container 22. The tips of the springs 18 are then supported by stationary plates 19 provided on a main body of the image forming apparatus, thereby pressing the developing device 3 towards the photosensitive drum 1.

Referring to FIG. 4, if the developing sleeve 12 requires maintenance, for example, the developing device 3 can be detached by first removing the stationary plates 19 and then sliding the developing device 3 along guide members 13 and 14.

With this technique in which the S-D-gap forming rollers (i.e., the positioning rollers 20) are placed in abutment with the photosensitive drum 1, the toner may possibly enter the gap between the positioning rollers 20 and the photosensitive drum 1 depending on the durability or the soiled condition thereof. This can cause vibration or fluctuation of the S-D gap, thus resulting in image defects.

A conceivable configuration for the prevention of such image defects is shown in FIGS. 6 and 7. In the description hereinafter, a direction in which the developing sleeve 12 abuts on the photosensitive drum 1 will be referred to as an "S-D direction". In this configuration, S-D-direction abutment blocks 16 that receive force acting in the S-D direction are provided concentrically with the photosensitive drum 1.

However, with regard to configurations that are made to press the developing device 3 towards the photosensitive member (i.e., the photosensitive drum 1), as shown in FIG. 6, such as the above-described configurations of the related art in which the S-D-gap forming rollers (i.e., the positioning rollers 20) are placed directly in abutment with the photosensitive drum 1 or are placed in abutment with the S-D-direction abutment blocks 16, the following problem exists. Specifically, since the developing device 3 and the guide members 13 and 14 have a clearance therebetween for a dimensional tolerance, there is play therebetween. For this reason, it is difficult to properly set the developing device 3 in position, as shown in FIGS. 10 and 11, thus making it difficult to set the S-D-gap forming rollers in position. In consequence, the S-D-gap forming rollers vibrate unfavorably due to the play between the developing device 3 and the guide members 13 and 14, thus making it difficult to maintain the S-D gap.

SUMMARY OF THE INVENTION

The present invention provides an image forming apparatus that can ensure that a gap be maintained between an image bearing member and a developer bearing member with high accuracy while accurately setting the developer bearing member in position without play with respect to the image bearing member.

An image forming apparatus includes an image bearing member, a developer bearing member configured to develop an electrostatic latent image formed on the image bearing member, gap forming members respectively provided on opposite sides of the developer bearing member and configured to form a gap between the image bearing member and the developer bearing member, a pressing device configured to press the developer bearing member towards the image bearing member, first abutment portions respectively disposed on opposite sides of the image bearing member and on which the gap forming members respectively abut as a result of the developer bearing member being pressed by the pressing device, and second abutment portions respectively disposed on the opposite sides of the image bearing member and on which the gap forming members respectively abut as the result of the developer bearing member being pressed by the pressing device, the gap forming members abutting on the second abutment portions at positions different from where the gap forming members abut on the first abutment portions.

Further features of the present invention will become apparent from the following description of exemplary embodiments with reference to the attached drawings.

DESCRIPTION OF THE EMBODIMENTS

Image Forming Apparatus

Figure 3:
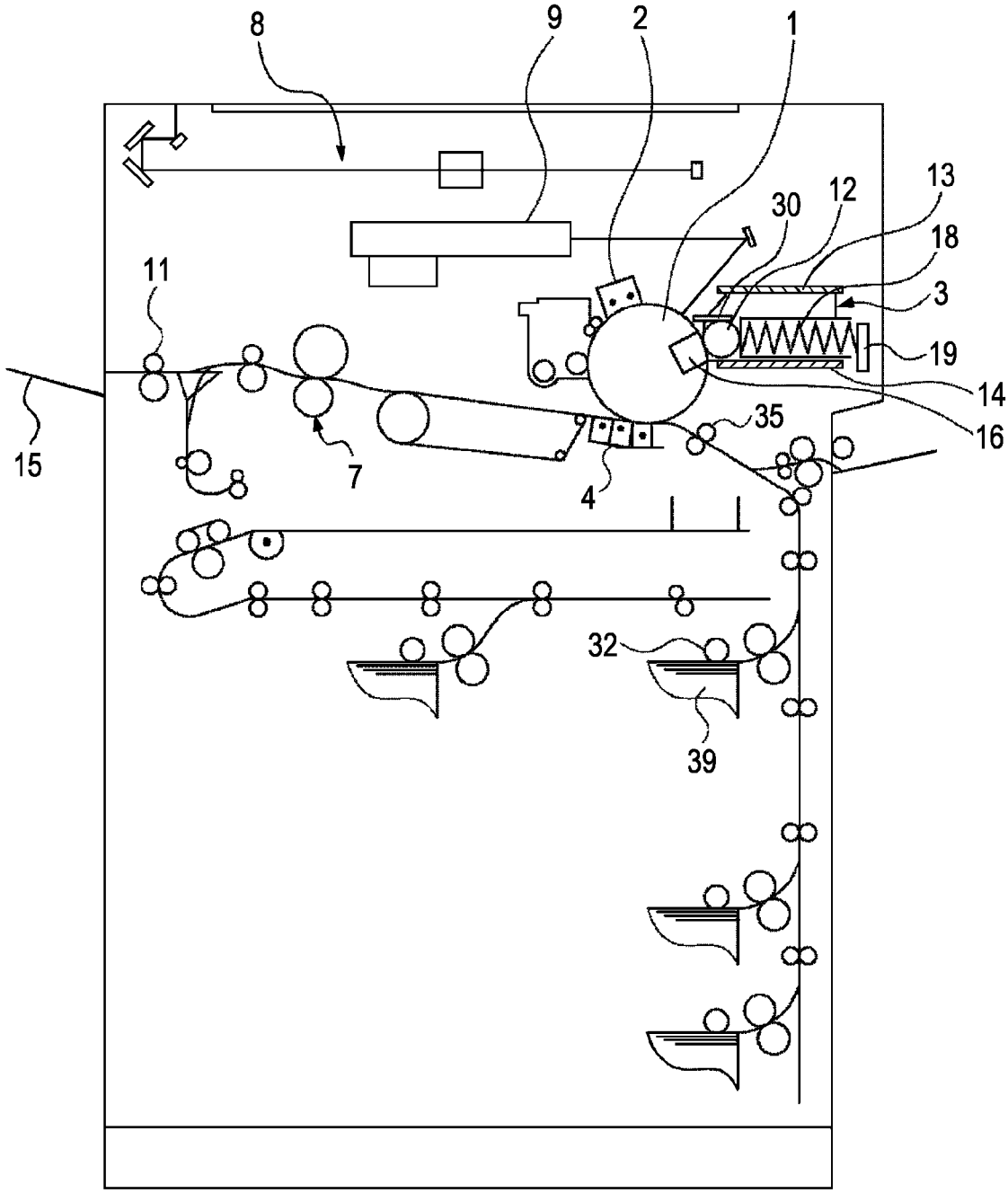
FIG. 3 is a schematic cross-sectional view showing an image forming apparatus.
Figure 4:
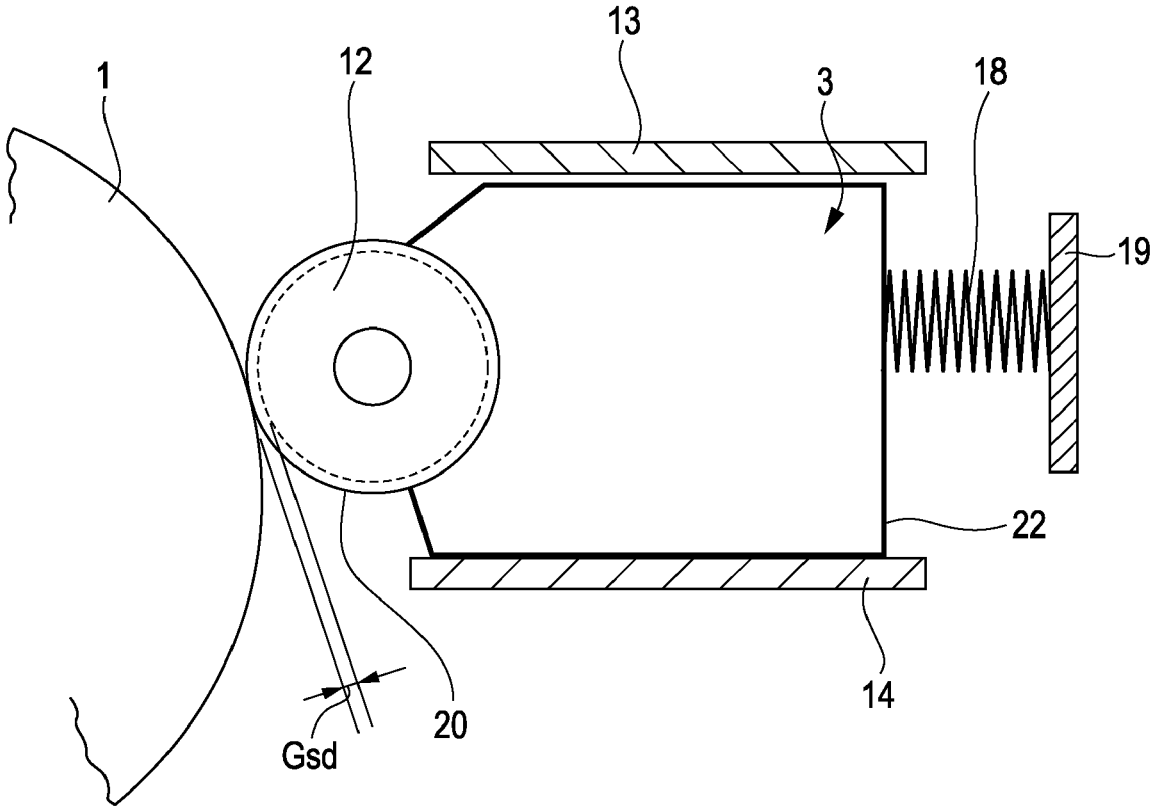
FIG. 4 is a side view of related art.
Figure 5:
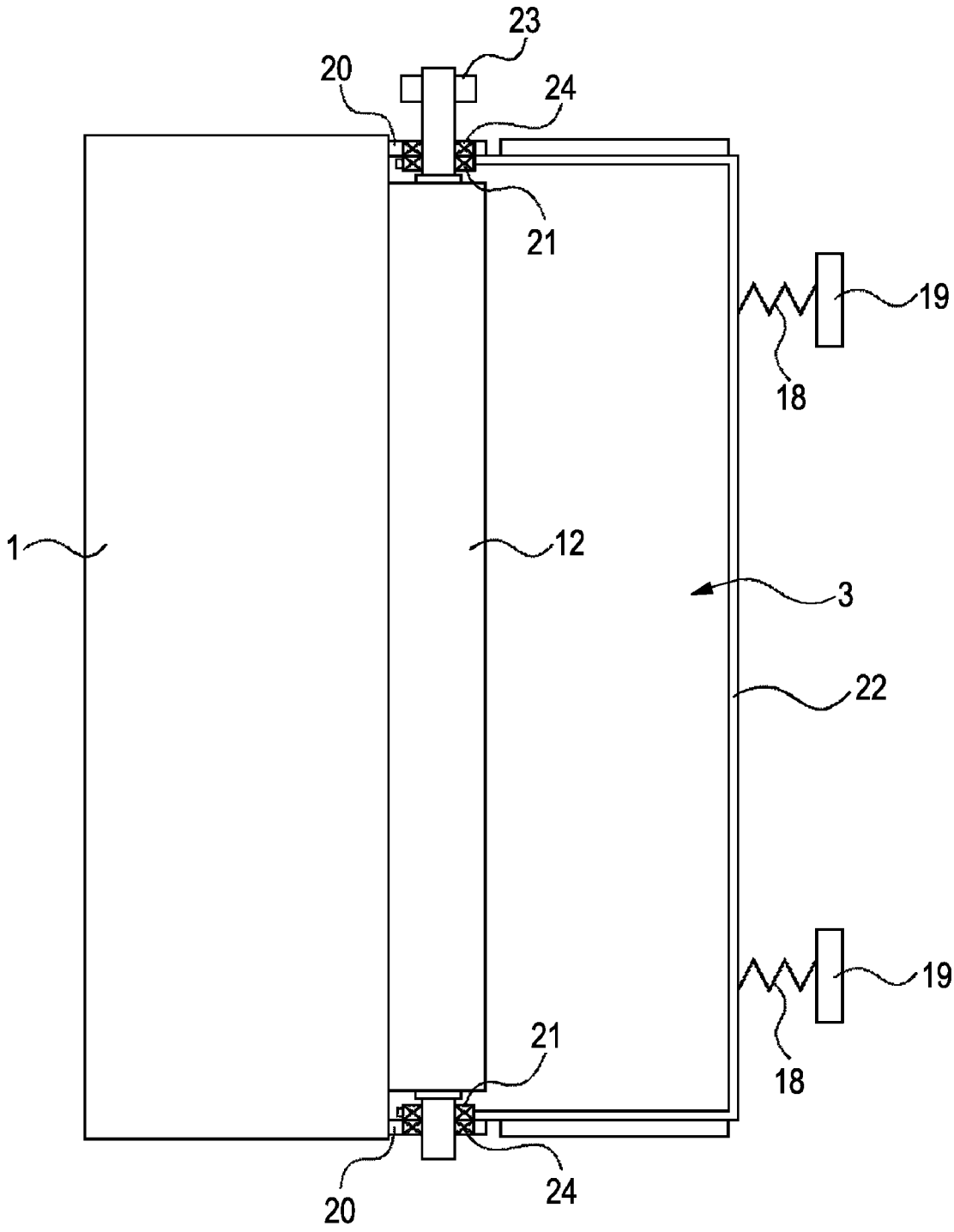
FIG. 5 is a top view of the related art.
Figure 6:
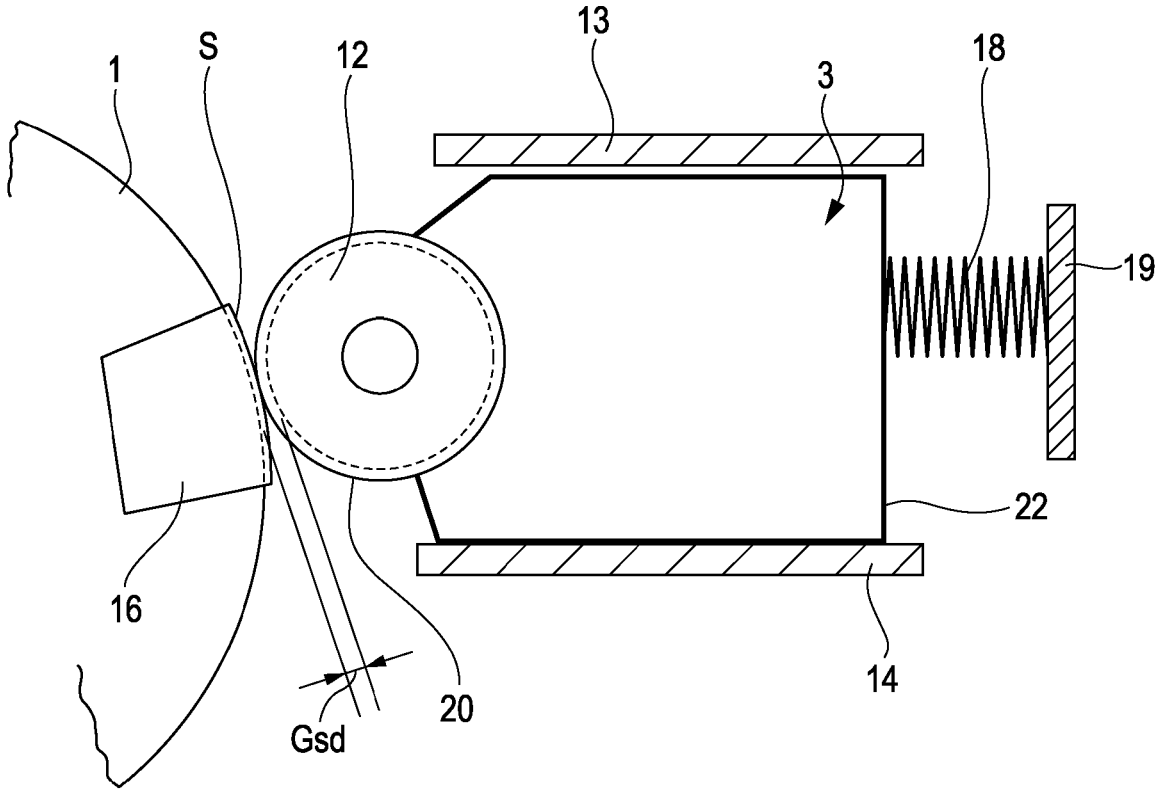
FIG. 6 is a side view of another related art.
Figure 7:
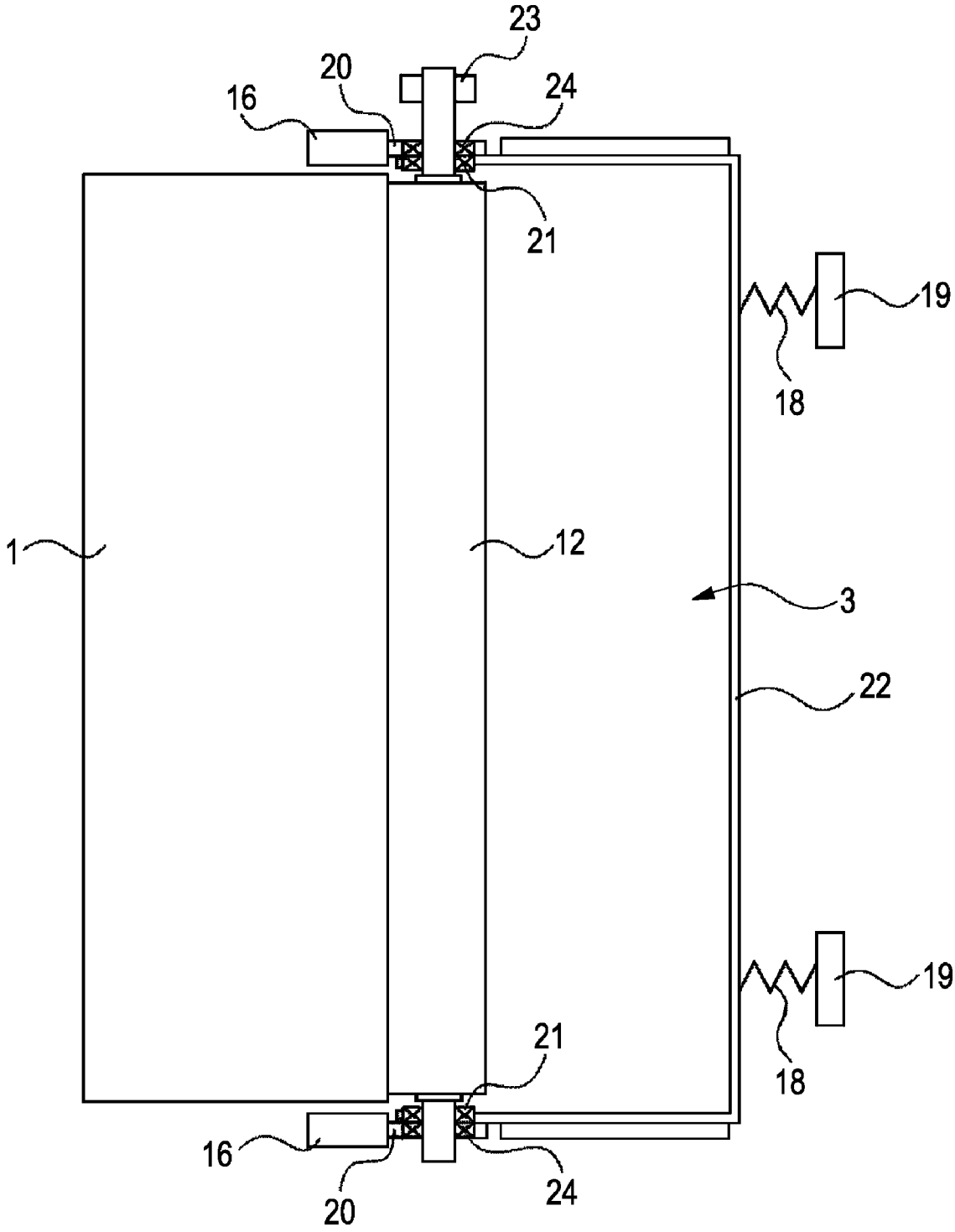
FIG. 7 is a top view of the related art shown in FIG. 6.

FIG. 3 illustrates an image forming apparatus according to a first embodiment of the present invention. The image forming apparatus according to the first embodiment is configured to read an image of an original at an image reading portion 8. In response to a command from a controller (not shown) based on the data of the read image, an image writing portion 9 exposes the surface of a photosensitive drum 1, serving as an image bearing member, to light so as to form an electrostatic latent image on the photosensitive drum 1. The photosensitive drum 1 is substantially cylindrical and is rotatably supported by the main body of the apparatus. Prior to the exposure, the surface of the photosensitive drum 1 is uniformly electrostatically-charged to a predetermined electric potential by a charging device 2. The image writing portion 9 irradiates the uniformly electrostatically-charged photosensitive drum 1 with, for example, a laser beam so as to form an electrostatic latent image on the photosensitive drum 1. The electrostatic latent image formed on the photosensitive drum 1 is developed by using toner of a developing device 3, and the developed toner image is subsequently conveyed to between the photosensitive drum 1 and a transfer device 4 by rotating the photosensitive drum 1.

In response to the conveyance of the developed toner image, a pickup roller 32 feeds sheets 39 one by one from a sheet cassette, and a pair of registration rollers 35 conveys the fed sheet 39 to between the photosensitive drum 1 and the transfer device 4 at a predetermined timing. As the sheet 39 passes through between the photosensitive drum 1 and the transfer device 4, the transfer device 4 transfers the developed toner image on the photosensitive drum 1 onto the sheet 39.

The sheet 39 with the toner image transferred thereon is conveyed to a pair of fixing rollers 7 by a predetermined conveying device. The fixing rollers 7 come into pressure-contact with the sheet 39 and heat the sheet 39 with heaters provided in the fixing rollers 7, whereby the toner on the sheet 39 is thermally fixed on the sheet 39. Subsequently, the sheet 39 with the toner image fixed thereon is ejected from the main body of the apparatus by an eject roller 11 so as to be accommodated in a tray 15 disposed on the exterior of the main body of the apparatus, whereby the image forming process ends.

Developing Device

Figure 1:
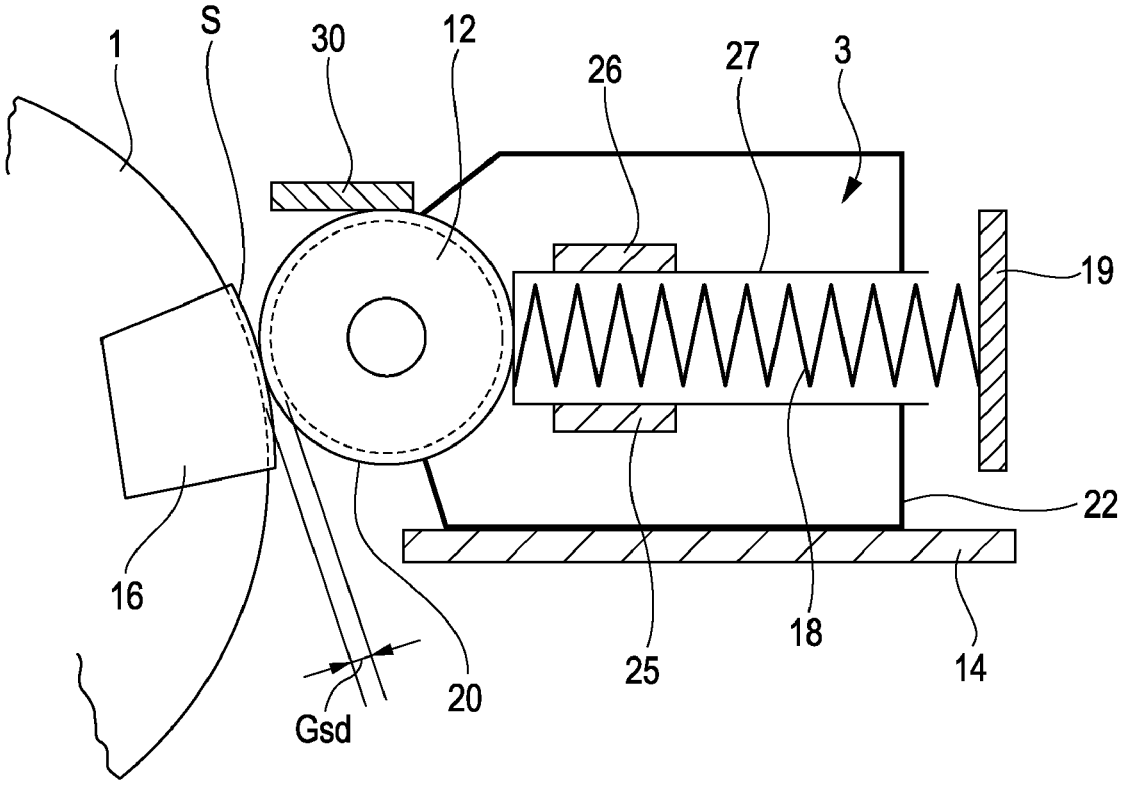
FIG. 1 is a side view of a first embodiment according to the present invention.
Figure 2:
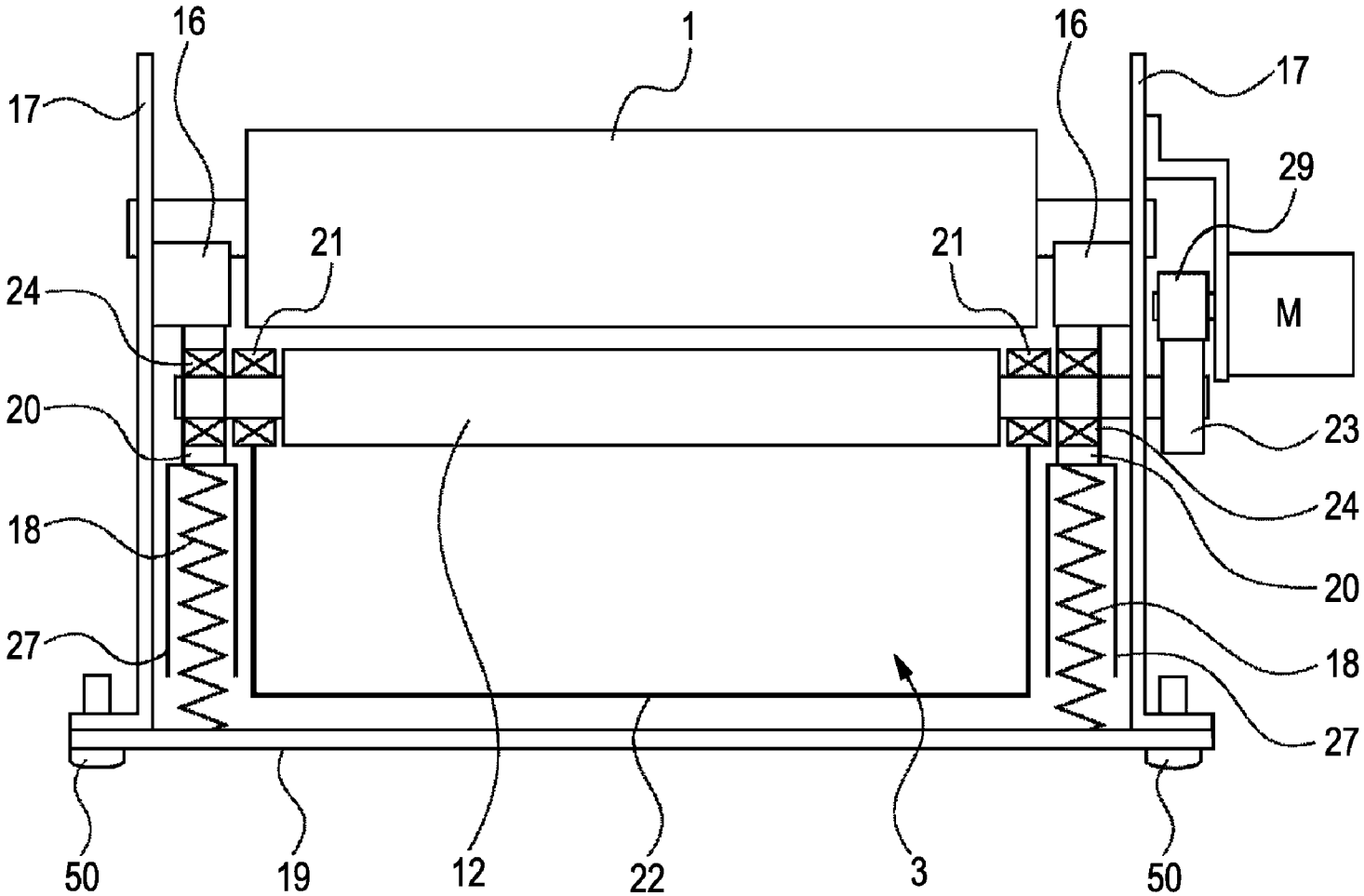
FIG. 2 is a top view of the first embodiment according to the present invention.

A pressing mechanism for the developing device 3 will be described in detail below with reference to FIGS. 1 and 2.

The opposite ends/sides of a developing sleeve 12 of the developing device 3 rotatably support positioning rollers 20, serving as gap forming members, by means of bearings 24. The developing sleeve 12 serves as a developer bearing member and is configured to develop an electrostatic latent image formed on the photosensitive drum 1 at a developing position where the photosensitive drum 1 and the developing sleeve 12 face each other.

The developing sleeve 12 is rotatably supported by a developer container 22 by means of bearings 21. One end of the developing sleeve 12 is provided with a gear 23 that applies a driving force for rotating the developing sleeve 12. The gear 23 is configured to receive the driving force from a driving source 29 fixed to one of side plates 17.

Spring holders 27 are used for pressing the positioning rollers 20 against abutment blocks 30 and high-precision surfaces S of S-D-direction abutment blocks 16 so as to set the developing sleeve 12 in position. Rotational movement of the developer container 22 is limited by a guide member 14 such that the developer container 22 is prevented from rotating about the developing sleeve 12.

The S-D-direction abutment blocks 16 are provided concentrically with the photosensitive drum 1 and have a shape with a radius greater than that of the photosensitive drum 1 by an amount equivalent to an S-D gap.

The S-D-direction abutment blocks 16 are respectively fixed to the side plates 17. The photosensitive drum 1 is supported by the side plates 17 in a rotatable manner by means of bearings (not shown). Accordingly, since the photosensitive drum 1 and the S-D-direction abutment blocks 16 are intervened by a small number of components, the dimensional accuracy between the surface of the photosensitive drum 1 and the high-precision surface S of each S-D-direction abutment block 16 is ensured. Moreover, because the high-precision surfaces S are provided concentrically with the surface of the photosensitive drum 1, even if the position of the abutment blocks 30 is raised or lowered to a certain extent, the S-D gap Gsd can still be maintained so long as the positioning rollers 20 are placed in abutment with the corresponding high-precision surfaces S.

By placing each positioning roller 20 in abutment with the surface of the corresponding abutment block 30 and the high-precision surface S of the corresponding S-D-direction abutment block 16, the developing sleeve 12 can be accurately set in position without play or deformation.

Figure 8:
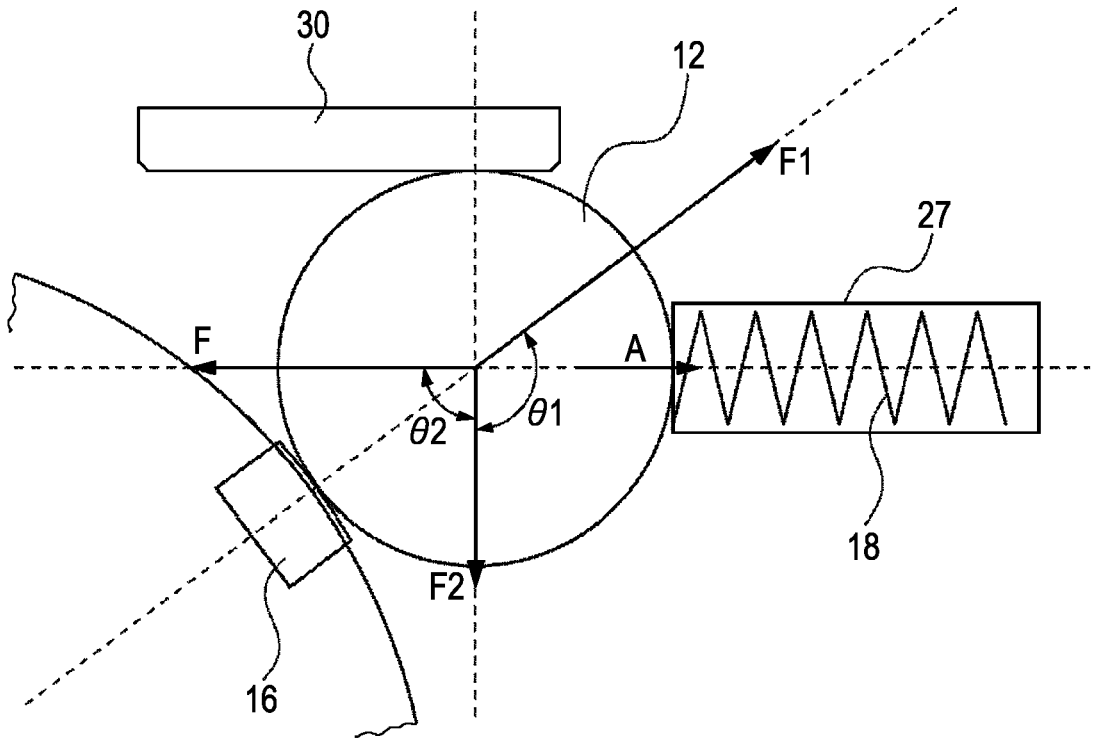
FIG. 8 is a vector diagram showing forces applied to a positioning roller.

Springs 18 that press the developing device 3 away from the main body of the apparatus have one end fixed to a stationary plate 19 and the other end fixed to the respective spring holders 27. Each spring holder 27 is supported by the corresponding side plate 17 in a slidable manner in the pressing direction by means of spring-holder guides 25 and 26. When performing maintenance, the developing device 3 can be detached by removing the stationary plate 19 from the side plates 17. As shown in FIG. 8, the developing device 3 is detachable in the horizontal direction (direction A).

Figure 12:
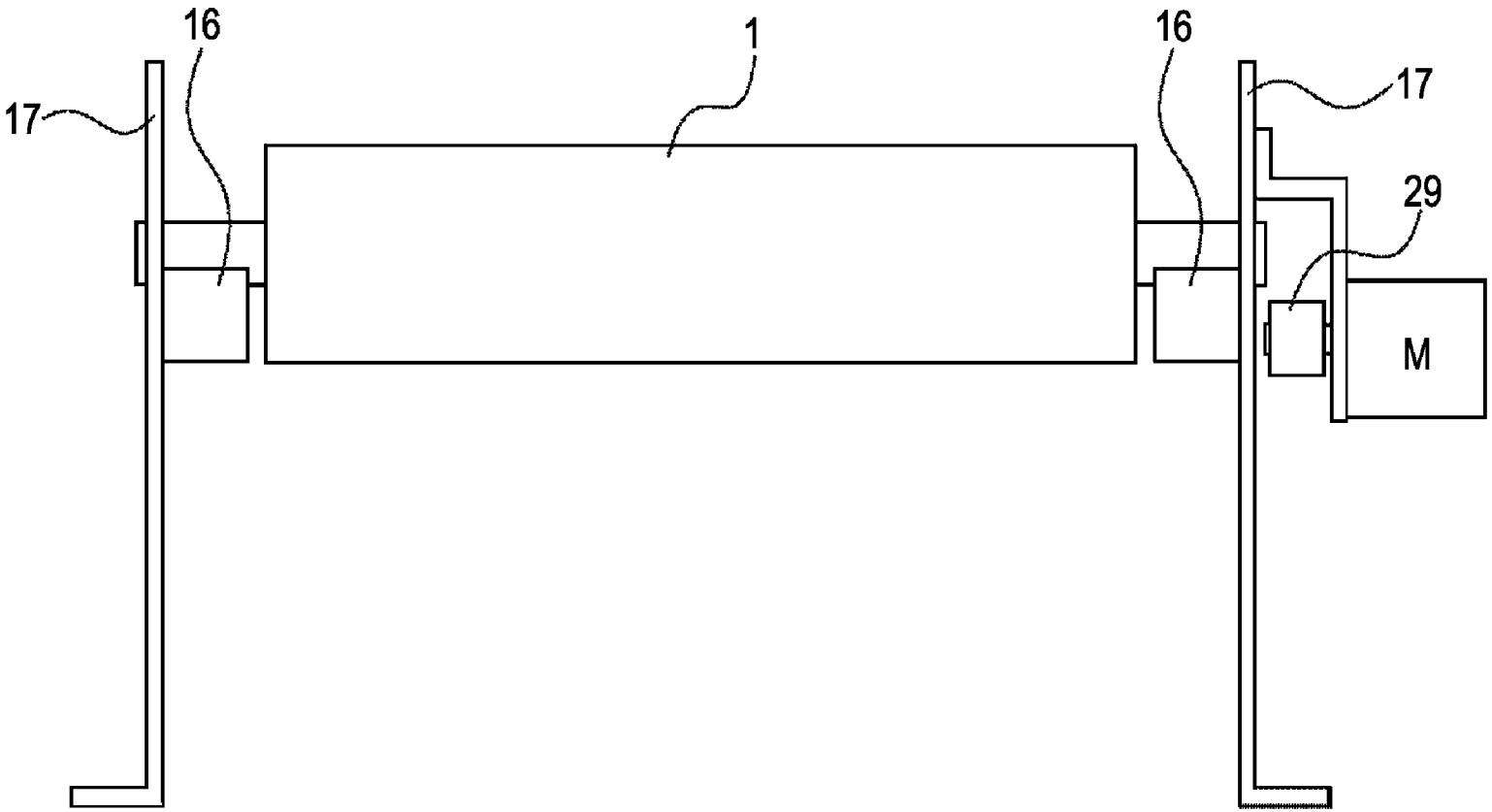
FIG. 12 illustrates a state where a developing device according to the present invention is removed.
Figure 13:
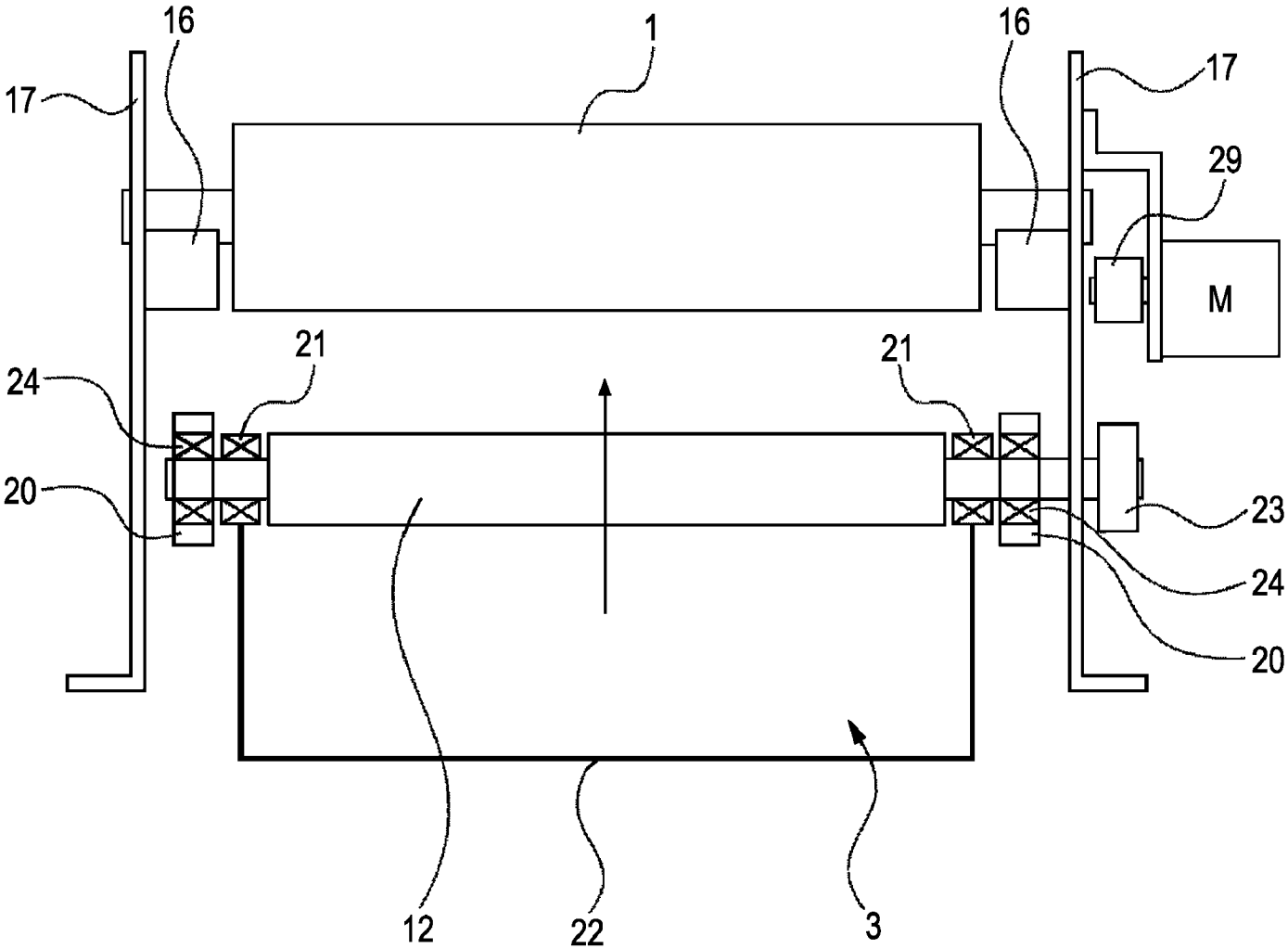
FIG. 13 illustrates an attachment process of the developing device according to the present invention.
Figure 14:
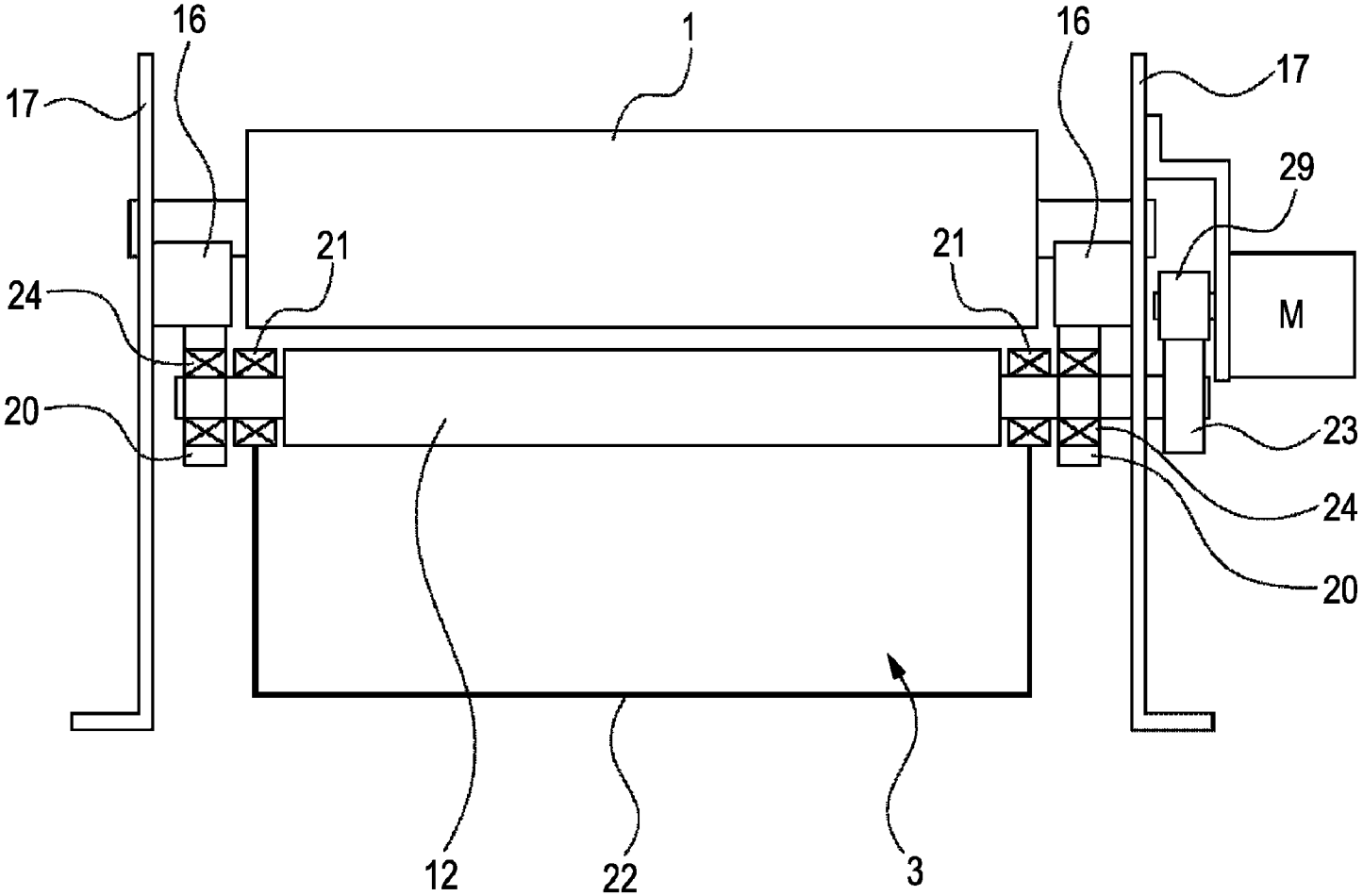
FIG. 14 also illustrates the attachment process of the developing device according to the present invention.
Figure 15:
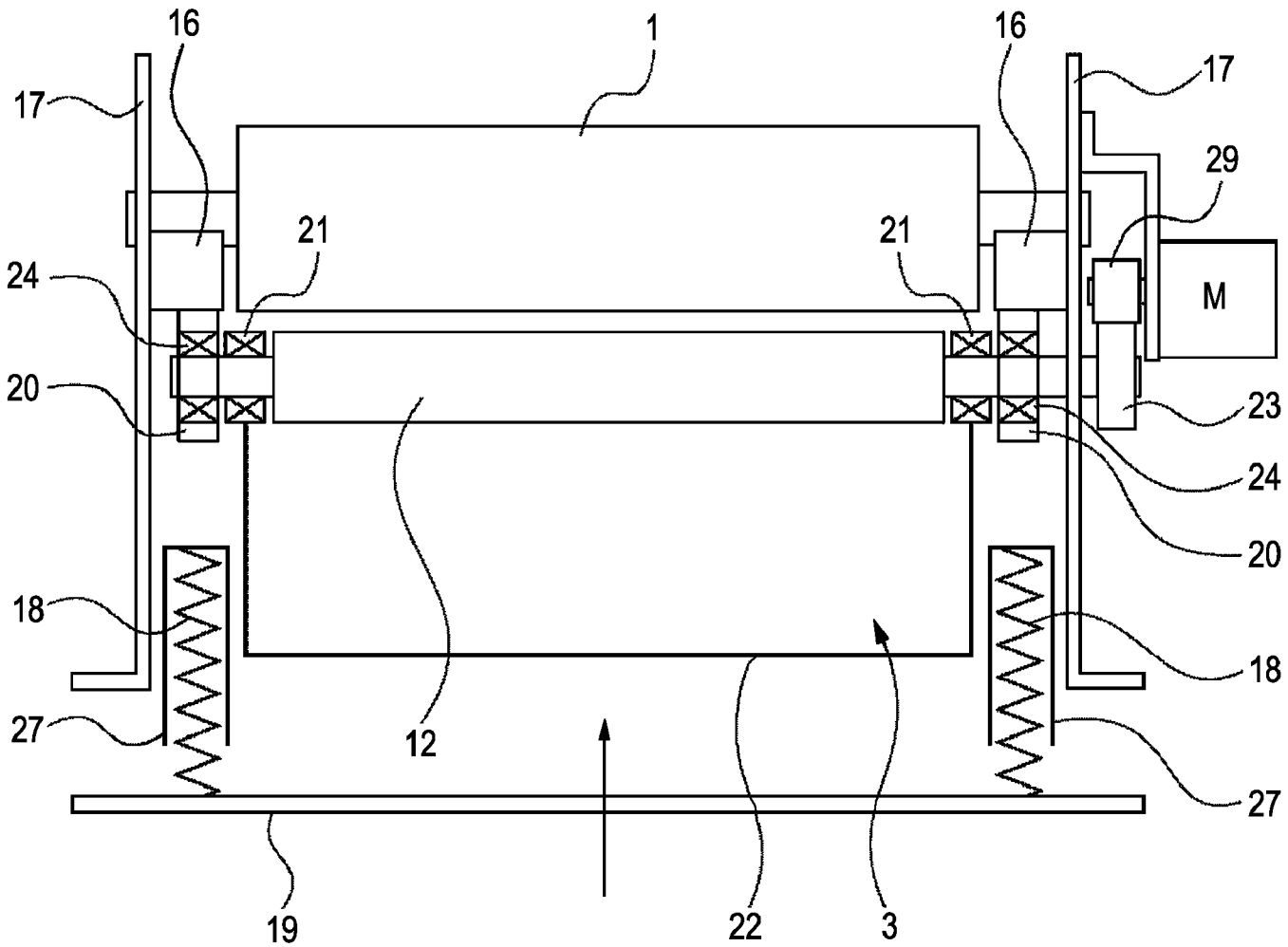
FIG. 15 also illustrates the attachment process of the developing device according to the present invention.

FIG. 12 illustrates a state where the developing device 3 is not disposed in the main body of the apparatus. From this state, the developing device 3 is inserted in a direction indicated by an arrow shown in FIG. 13 until the positioning rollers 20 are brought into abutment with the S-D-direction abutment blocks 16 (see FIG. 14). Subsequently, an operator may hold a pressing device, which integrally supports the stationary plate 19, the springs 18, and the spring holders 27, so as to press the developing device 3 towards the photosensitive drum 1, as shown in FIG. 15. The operator may then fasten the stationary plate 19 to the side plates 17 using fixing screws 50 (see FIG. 2).

Abutment Members

The characteristic features of the first embodiment will now be described. In the first embodiment, the surface of each abutment block 30 and the high-precision surface S of the corresponding S-D-direction abutment block 16 form a substantially V-shape in cross section, as shown in FIG. 8, and the developer container 22 is pressed so that the corresponding positioning roller 20 is fitted in this V-shape. Specifically, when the developing device 3 is pressed by the springs 18, the positioning rollers 20 are in abutment with both the S-D-direction abutment blocks 16 and the abutment blocks 30. Each positioning roller 20 is set in position by being pressed against the corresponding abutment block 30 by a force component of a reactive force F1 produced when the positioning roller 20 abuts on the corresponding S-D-direction abutment block 16. In this manner, the positioning rollers 20 are set in position with respect to the photosensitive drum 1.

Here, the S-D-direction abutment blocks 16 each have a curved surface that is concentric with the photosensitive drum 1 and that has substantially the same radius as that of the photosensitive drum 1. The S-D-direction abutment blocks 16 serve as first abutment members having first abutment surfaces on which the positioning rollers 20 provided at the opposite ends/sides of the developing sleeve 12 respectively abut. The abutment blocks 30 are respectively disposed at the opposite ends/sides of the developing sleeve 12 and serve as second abutment members having second abutment surfaces on which the positioning rollers 20 respectively abut.

The abutment blocks 30 extend substantially in parallel to the direction in which the positioning rollers 20 are pressed by the pressing device.

In the first embodiment, as shown in FIG. 8, the developer container 22 is pressed towards the photosensitive drum 1 by the springs 18 constituting the pressing device. In this case, a direction F in which the springs 18 press the developer container 22 intersects with a line that connects the center of rotation of the photosensitive drum 1 and the center of rotation of the developing sleeve 12. In consequence, the direction of the reactive force F1 produced when each positioning roller 20 abuts on the corresponding S-D-direction abutment block 16 is inclined with respect to the pressing direction by the pressing device. Therefore, the reactive force F1 acting on the positioning roller 20 causes the positioning roller 20 to be pressed against the corresponding abutment block 30. Moreover, the positioning roller 20 is set in position by receiving a reactive force F2 from the abutment block 30 produced as the result of the positioning roller 20 being pressed against the abutment block 30 by the reactive force F1.

Furthermore, when the developer container 22 is pressed by the springs 18, each of the positioning rollers 20 is brought into abutment with at least one of the corresponding abutment block 30 and the corresponding S-D-direction abutment block 16. Moreover, with the reactive force produced when the positioning roller 20 abuts on at least one of the abutment block 30 and the S-D-direction abutment block 16, the positioning roller 20 can be pressed towards the other block. Although the positioning rollers 20 are configured to be brought into abutment with the S-D-direction abutment blocks 16 in the first embodiment, the present invention is not limited to this configuration. An alternative configuration is permissible, in which, for example, the positioning rollers 20 receive a reactive force from the abutment blocks 30 by being brought into abutment with the abutment blocks 30 by the springs 18, and the positioning rollers 20 are pressed against the S-D-direction abutment blocks 16 by this reactive force.

The balance of forces applied to each positioning roller 20 will now be described.

If a force with which the spring holder 27 presses the positioning roller 20 by means of the spring 18 is denoted by F and the value of the force F at each side is 24 N, a total force of 48 N is required for the operator to hold the stationary plate 19 when performing maintenance on the developing device 3.

A normal force received by the positioning roller 20 from the S-D-direction abutment block 16 is denoted by F1, a normal force that the abutment block 30 applies to the positioning roller 20 is denoted by F2, an angle formed between the direction of F1 and the direction of F2 is denoted by $\theta 1$, and an angle formed between the direction of F and the direction of F2 is denoted by $\theta 2$.

The abutment block 30 is disposed such that an angle formed between the direction of F2 and the detaching direction (direction A) of the developing device 3 is 90°. In this manner, the developing device 3 can be readily detached from the main body of the apparatus without being blocked by the abutment block 30.

Figure 9:
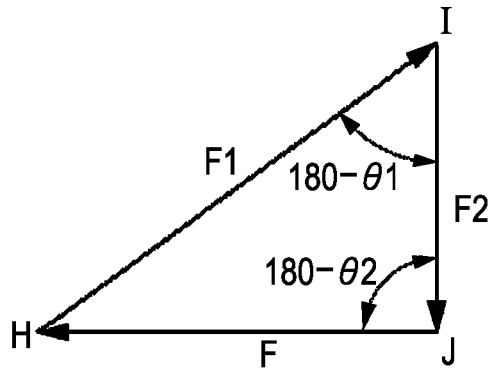
FIG. 9 is a vector diagram showing the balance of forces applied to the positioning roller.
Figure 10:
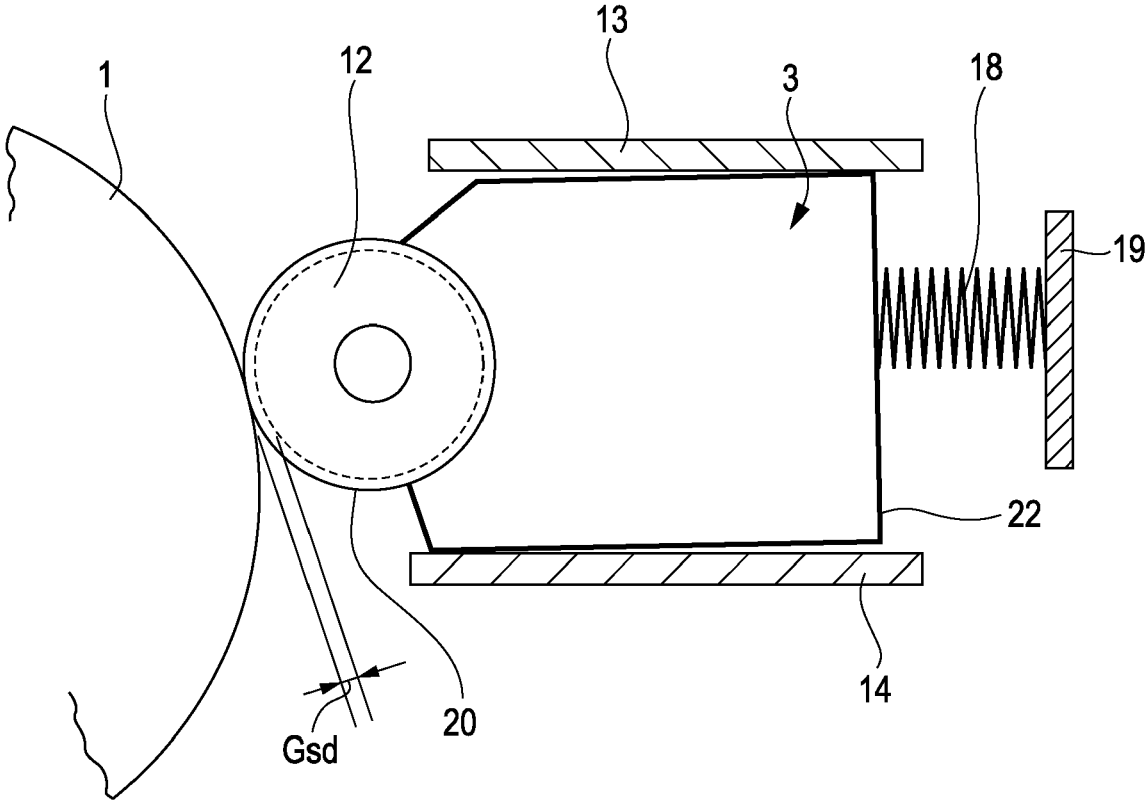
FIG. 10 illustrates a problem of the related art.
Figure 11:
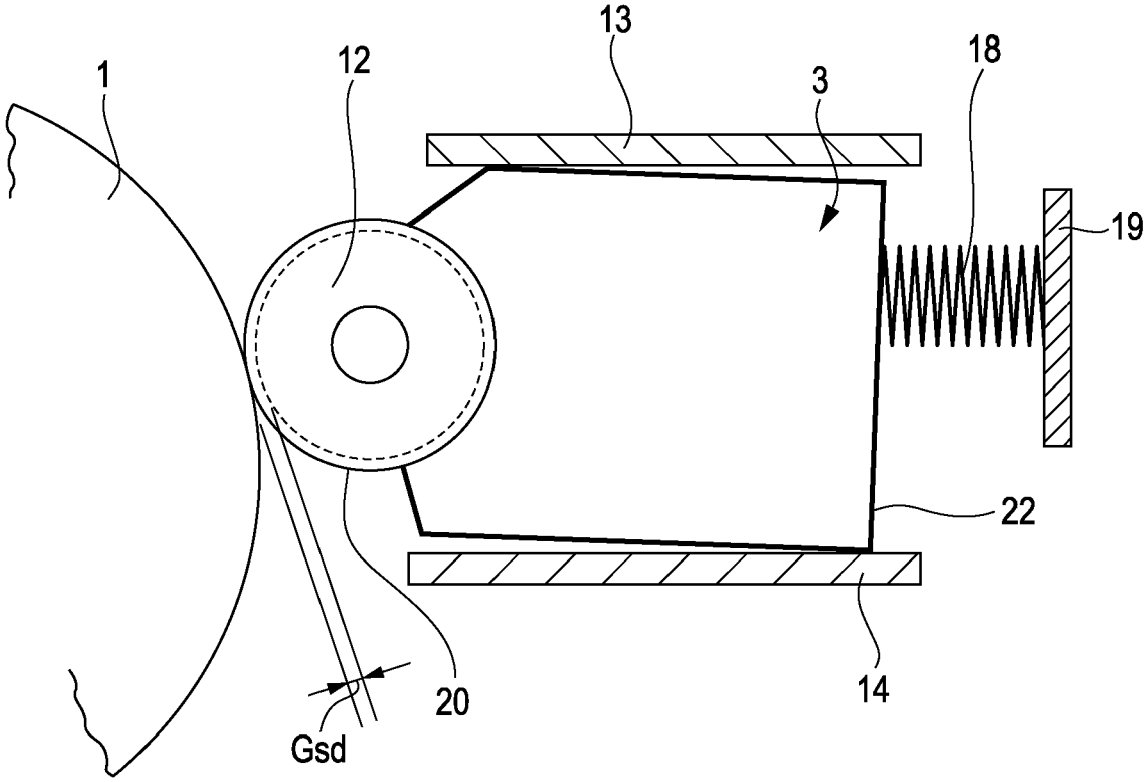
FIG. 11 illustrates a problem of the related art.

FIG. 9 is a vector diagram showing the balance of forces applied to each positioning roller 20 when the positioning roller 20 is in a balanced state while being pressed by the pressing device.

In the first embodiment, the abutment block 30 is disposed so as to satisfy the following conditions: $\theta 1=126.7°$ and $\theta 2=90°$. In other words, $\theta 1>\theta 2$.

Thus, $F1=24N/\sin(180-126.7)°=30N$, thereby achieving the condition $F<F1$. Consequently, the required biasing force can be attained without having to increase the force of the spring 18.

In general, with respect to a triangle HIJ in FIG. 9 showing the vector diagram of the balance of forces, the condition $\angle HIJ<\angle IJH$ should be satisfied in order to achieve the condition $F<F1$.

In other words, $(180°-\theta 1)<(180°-\theta 2)$, and the condition $F<F1$ can be achieved so long as $\theta 1>\theta 2$.

Since the force of the spring 18 can be reduced in this manner, the operator can remove the developing device 3 with small force, thereby facilitating maintenance thereof.

In the first embodiment described above, each positioning roller 20 is pressure-supported by being held between the corresponding S-D-direction abutment block 16 and the corresponding abutment block 30. Thus, the positioning rollers 20 can be supported without play, and the S-D gap can be constantly maintained between the developing sleeve 12 and the photosensitive drum 1.

Although the first embodiment is directed to an example in which the S-D-direction abutment blocks 16 are used, the positioning rollers 20 may be directly placed in abutment with the photosensitive drum 1 without providing the S-D-direction abutment blocks 16 therebetween. In that case, the surface of the photosensitive drum 1 on which the positioning rollers 20 abut serves as a first abutment surface on which the positioning rollers 20 abut.

A second embodiment of the present invention will now be described. The second embodiment only differs from the first embodiment in the position of the abutment blocks 30. Other points are the same as those in the first embodiment.

Figure 16:
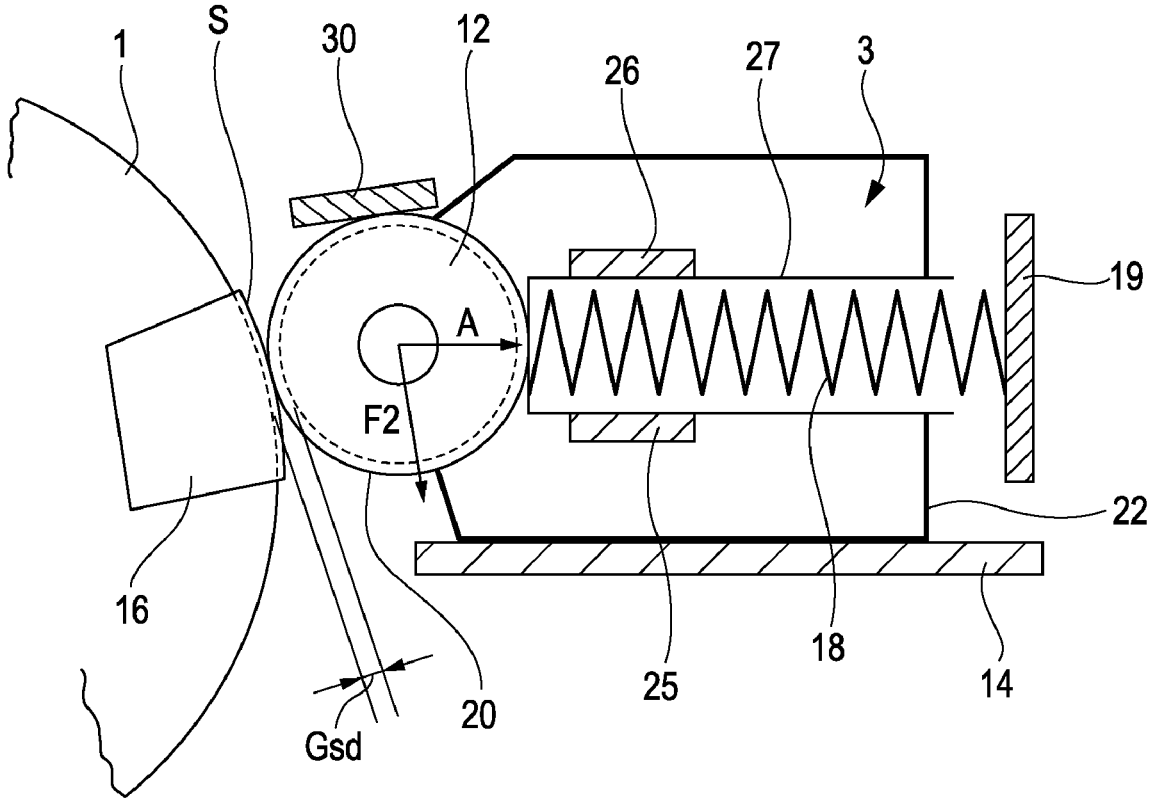
FIG. 16 illustrates the position of an abutment block according to a second embodiment of the present invention.

Referring to FIG. 16, in the second embodiment, if an angle formed between the direction A, which is the detaching direction of the developing device 3, and the direction of the reactive force F2 received by the developing sleeve 12 from each abutment block 30 is denoted by $\phi$, the abutment block 30 is disposed so as to satisfy the condition $0°<\phi<90°$.

Figure 17:
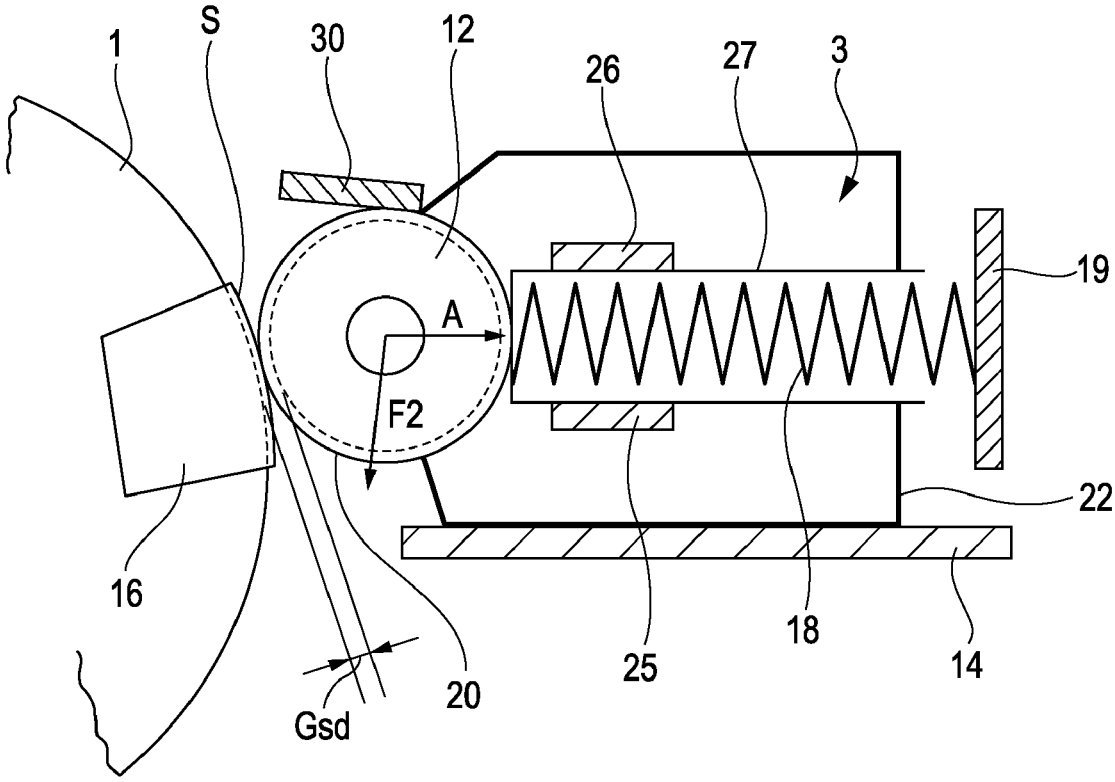
FIG. 17 illustrates a comparison example in which the detachability of the developing device is impaired.

In this case, if $\theta 1>\theta 2$ is satisfied, then $F<F1$, thereby allowing for easy detachment of the developing device 3, as in the first embodiment. Even when $\theta 1>\theta 2$ as in FIG. 17 showing a comparison example, if the angle formed between the direction A and the direction of the reactive force F2 is 90° or more, the positioning roller 20 gets blocked by the abutment block 30 when detaching the developing device 3, thus impairing the detachability of the developing device 3.

Accordingly, in the second embodiment, the angle $\phi$ formed between the direction A, which is the detaching direction of the developing device 3, and the direction of the reactive force F2 received by the developing sleeve 12 from the abutment block 30 is set so as to satisfy the condition $0° < \phi < 90°$, thereby achieving improved detachability of the developing device 3 as well as the same advantages of the first embodiment.

According to the present invention, the gap between the image bearing member and the developer bearing member can be maintained with high accuracy while the developer bearing member can be accurately set in position without play with respect to the image bearing member.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-290000 filed Nov. 12, 2008, which is hereby incorporated by reference herein in its entirety.

What is claimed is:

1. An image forming apparatus comprising:

an image bearing member;

a developer bearing member configured to develop an electrostatic latent image formed on the image bearing member;

gap forming members respectively provided on opposite sides of the developer bearing member and configured to form a gap between the image bearing member and the developer bearing member;

a pressing device configured to press the developer bearing member towards the image bearing member;

first abutment portions respectively disposed on opposite sides of the image bearing member and on which the gap forming members respectively abut as a result of the developer bearing member being pressed by the pressing device; and second abutment portions respectively disposed on the opposite sides of the image bearing member and on which the gap forming members respectively abut as the result of the developer bearing member being pressed by the pressing device, the gap forming members abutting on the second abutment portions at positions different from where the gap forming members abut on the first abutment portions, wherein the first abutment portions and the second abutment portions are disposed so as to satisfy the condition $\theta 1 > \theta 2$, wherein $\theta 1$ denotes an angle formed between a direction of a reactive force F1 and a direction of a reactive force F2, the reactive force F1 being a reactive force applied to each gap forming member from the first abutment portion, the reactive force F2 being a reactive force applied to each gap forming member from the second abutment portion, and wherein $\theta 2$ denotes an angle formed between a direction of a force F and the direction of the reactive force F2, the force F being a force with which the pressing device presses each gap forming member.

2. The image forming apparatus according to claim 1, wherein the first abutment portions and the second abutment portions are disposed such that, when the developer bearing member is pressed by the pressing device, a reactive force produced as a result of each gap forming member abutting on at least one of the first abutment portion and the second abutment portion causes the gap forming member to be pressed against the other one of the first abutment portion and the second abutment portion.

3. The image forming apparatus according to claim 1, wherein the second abutment portions are provided substantially in parallel to a direction in which the gap forming members are pressed by the pressing device.

4. The image forming apparatus according to claim 1, wherein a direction in which the pressing device presses each gap forming member intersects with a line that connects a center of the image bearing member and a center of the gap forming member.

5. The image forming apparatus according to claim 1, wherein the first abutment portions comprise abutment members provided respectively on the opposite sides of the image bearing member and each having a surface that is concentric with the image bearing member.

6. The image forming apparatus according to claim 1, wherein the first abutment portions comprise the image bearing member.

7. The image forming apparatus according to claim 1, wherein the pressing device directly presses an outer periphery of the gap forming members.

* * * * *